US008920000B2

(12) United States Patent
Horng

(10) Patent No.: US 8,920,000 B2
(45) Date of Patent: Dec. 30, 2014

(54) LAMP

(71) Applicant: Sunonwealth Electric Machine Industry Co., Ltd., Kaohsiung (TW)

(72) Inventor: Alex Horng, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 252 days.

(21) Appl. No.: 13/669,736

(22) Filed: Nov. 6, 2012

(65) Prior Publication Data

US 2013/0271996 A1 Oct. 17, 2013

(30) Foreign Application Priority Data

Apr. 11, 2012 (TW) ..... 101112814 A

(51) Int. Cl.
*F21V 29/02* (2006.01)

(52) U.S. Cl.
USPC ..... 362/294; 362/373; 362/646; 313/35

(58) Field of Classification Search
CPC ..... F21K 9/13; F21K 9/135; F21K 9/1355; F21K 9/137; F21K 9/1375; F21V 23/006; F21V 29/025; F21V 29/027; F21S 8/04
USPC ..... 362/294, 373, 646; 313/35, 36
See application file for complete search history.

(56) References Cited

U.S. PATENT DOCUMENTS

| | | | | |
|---|---|---|---|---|
| 6,864,513 | B2 * | 3/2005 | Lin et al. | 257/99 |
| 7,144,135 | B2 * | 12/2006 | Martin et al. | 362/294 |
| 7,682,054 | B2 * | 3/2010 | Hsu et al. | 362/373 |
| 7,758,223 | B2 * | 7/2010 | Osawa et al. | 362/547 |
| 8,319,408 | B1 * | 11/2012 | Horng | 313/46 |
| 8,541,932 | B2 * | 9/2013 | Horng | 313/46 |
| 8,573,817 | B2 * | 11/2013 | Fang | 362/373 |
| 8,622,577 | B2 * | 1/2014 | Kemps et al. | 362/249.02 |
| 2010/0264799 | A1 * | 10/2010 | Liu et al. | 313/46 |

FOREIGN PATENT DOCUMENTS

| | | |
|---|---|---|
| TW | M330426 | 4/2008 |
| TW | I360625 | 8/2010 |
| TW | M408005 | 7/2011 |

* cited by examiner

*Primary Examiner* — Alan Cariaso
(74) *Attorney, Agent, or Firm* — Muncy, Geissler, Olds & Lowe, P.C.

(57) ABSTRACT

The invention discloses a lamp including a lampshade, a cooling module, a light-emitting element and a circuit board. The lampshade includes an opening and a base. The lampshade forms a chamber. The lampshade is completely closed between the opening and the base. The cooling module includes a cooling fan fixed in the chamber while at least one air-guiding gap is formed between the cooling module and the lampshade. The light-emitting element is coupled with the cooling module. The circuit board has a layout surface mounted with a plurality of electronic components. The inner surface of the lampshade forms an air-guiding face. The layout surface, the air-guiding face and the cooling fan jointly constructs an air channel. The layout surface and the electronic components of the circuit board face the opening of the lampshade. At least one of the electronic components is located in the air channel.

18 Claims, 10 Drawing Sheets

LAMP

BACKGROUND OF THE INVENTION

1. Field of the Invention

The present invention generally relates to a lamp and, more particularly, to a lamp that allows air driven by a cooling fan to reach a circuit board for cooling purpose.

2. Description of the Related Art

FIG. 1 shows a conventional lamp 7 disclosed in Taiwan Patent No. M330426 entitled "COOLING STRUCTURE OF A LAMP". The lamp 7 includes a cooling seat 71, a circuit board 72, a light-emitting diode (LED) module 73, a cooling fan 74 and a head 75. The cooling seat 71 has a recessed portion 711 and a receiving portion 712 opposite to the recessed portion 711. The circuit board 72 and the LED module 73 are mounted in the recessed portion 711. The cooling fan 74 is mounted in the receiving portion 712. The head 75 is electrically connected to an external power and the circuit board 72, as well as to a periphery of the receiving portion 712. The cooling seat 71 includes a plurality of cooling vents 76 that allows the external air to flow into the receiving portion 712 therethrough. The head 75 includes a plurality of air-guiding holes 77 that allows the external air to flow into the receiving portion 712 therethrough. In this arrangement, the cooling fan 74 draws air into the receiving portion 712 via the air-guiding holes 77 and expels air from the receiving portion 712 via the cooling vents 76 during the operation thereof. In this mechanism, the heat generated by the head 75 is expelled.

When the lamp 7 operates, the heat of the head 75 can be discharged but the heat generated by a plurality of electronic components of the circuit board 72 cannot. Since the electronic components tend to overheat during the operation of the lamp 7, breakdown of the lamp 7 is easily caused. The service life of the lamp 7 is even shortened.

It is often required to install the lamp 7 in a decorated ceiling for aesthetics. However, this will affect the ventilation and cooling effects of the lamp 7. This is because the cooling vents 76 and the air-guiding holes 77 that are respectively formed on the cooling seat 71 and the head 75 will be settled in a non-ventilated space above the decorated ceiling while exposing the LED module 73 to the room for illumination purposes. The non-ventilated space between the decorated ceiling and the concrete ceiling in the floor of a building usually lacks ventilation. Therefore, heat may accumulate in the lamp 7, shortening the service life of the lamp 7. In addition, since the cooling vents 76 and the air-guiding holes 77 are respectively formed on the cooling seat 71 and the head 75, aesthetics integrity of the lamp 7 is poor.

FIG. 2 shows a conventional lamp 8 disclosed in Taiwan Patent No. M408005 entitled "SLEEVE LAMP SEAT WITH COOLING FUNCTION". The lamp 8 includes a sleeve lampshade 81 and a fan 82. The sleeve lampshade 81 forms a plurality of holes 811 on the bottom thereof. The fan 82 is mounted in the sleeve lampshade 81 for guiding the air into and out of the lamp 8 via the holes 811 to prevent the lamp 8 from overheating.

The lamp 8 further includes a circuit board 83 mounted in the sleeve lampshade 81. The circuit board 83 is mounted with a plurality of electronic components 831 for controlling the operations of the lamp 8. Since the electronic components 831 are located in a narrow space between the sleeve lampshade 81 and the circuit board 83, the air driven by the fan 82 cannot reach the electronic components 831 for cooling purposes. Consequently, the electronic components 831 will overheat during the operation of the lamp 8, leading to breakdown of the lamp 8 and shortening the service life of the lamp 8.

FIG. 3 shows a conventional lamp 9 disclosed in Taiwan Patent Publication No. 201030280 entitled "LAMP". The lamp 9 includes a housing 91, a light-emitting element 92, a circuit board 93 and a cooling fan 94. The housing 91 forms a plurality of air inlets 911 and a plurality of air outlets 912. The light-emitting element 92 is mounted in the housing 91 and electrically connected to the circuit board 93. The circuit board 93 is mounted with a plurality of electronic components 931. The cooling fan 94 is mounted in the housing 91 and directly drives the air through the electronic components 931 of the circuit board 93 to expel the heat of the circuit board 93, ensuring the normal operation of the lamp 9.

In the lamp 9, although the air driven by the cooling fan 94 is allowed to reach the circuit board 93 for expelling the heat of the electronic components 931, the lamp 9 has poor appearance integrity and complex structure due to the arrangement of the air inlets 911 and the air outlets 912. Furthermore, when the lamp 9 is installed in the decorated ceiling while the light-emitting element 92 is exposed to the room for illumination purposes, the ventilation and cooling effects of the lamp 9 are affected because the air inlets 911 and the air outlets 912 are located in the non-ventilated space above decorated ceiling. As a result, the service life of the lamp 9 is shortened. In light of this, it is necessary to improve the conventional lamps.

SUMMARY OF THE INVENTION

It is therefore the objective of this invention to provide a lamp that allows air driven by a cooling fan to reach a circuit board for expelling the heat generated by a plurality of electronic components of the circuit board, ensuring the normal operation of the lamp.

It is another objective of this invention to provide a lamp which does not form any air inlets and air outlets on a lampshade thereof, significantly simplifying the structure of the lamp for convenient manufacturing.

It is yet another objective of this invention to provide a lamp which smoothly guides air into and out of the lamp when the lamp is installed in the wall or ceiling, improving the cooling efficiency and ensuring the normal operation thereof.

One embodiment of the invention discloses a lamp comprising a lampshade, a cooling module, a light-emitting element and a circuit board. The lampshade includes an opening and a base at two ends thereof. The lampshade forms a chamber in communication with the opening. The lampshade is completely closed between the opening and the base. The cooling module includes a cooling fan fixed in the chamber of the lampshade, with at least one air-guiding gap formed between the cooling module and an inner surface of the lampshade. The light-emitting element is coupled with the cooling module. The circuit board is electrically connected to the base and the light-emitting element and has a layout surface mounted with a plurality of electronic components. The inner surface of the lampshade forms an air-guiding face between the base and the opening. The layout surface of the circuit board, the air-guiding face of the lampshade, and the cooling fan jointly form an air channel. The layout surface and the electronic components of the circuit board face the opening of the lampshade. At least one of the electronic components is located in the air channel.

In a preferred form shown, the air-guiding face of the lampshade is in an annular form and has a diameter gradually reduced from the opening to the base.

In the preferred form shown, the cooling fan includes an air inlet facing the base and an air outlet facing away from the base, with the air-guiding gap acting as an airflow entrance. Alternatively, the cooling fan includes an air outlet facing the base and an air inlet facing away from the base, with the air-guiding gap acting as an airflow exit.

In the preferred form shown, the air channel includes an air-diverting channel being the part of the air channel that corresponds to the cooling fan in an axial direction. The at least one of the electronic components is located in the air-diverting channel. Preferably, the air channel includes an air-diverting channel being the part of the air channel located above the cooling fan.

In the preferred form shown, the lampshade includes a plurality of fixing posts in the chamber, the cooling fan of the cooling module and the circuit board are fixed to the fixing posts via a plurality of fixing members.

In the preferred form shown, the cooling module further includes a cooling seat. The light-emitting element is coupled with one face of the cooling seat, and the cooling fan is coupled with the other face of the cooling seat, thereby positioning the cooling seat between the light-emitting element and the cooling fan.

In the preferred form shown, the cooling module has a bottom edge forming a radial extension portion. The radial extension portion divides the air-guiding gap into a radial airflow entrance and an axial airflow exit, or divides the air-guiding gap into a radial airflow exit and an axial airflow entrance.

The other embodiment of the invention discloses a lamp comprising a lampshade, a cooling module, a light-emitting element and a circuit board. The lampshade includes an opening and a base at two ends thereof. The lampshade forms a chamber in communication with the opening. The lampshade is sealed between the opening and the base. The cooling module includes a cooling fan fixed in the chamber of the lampshade. At least one air-guiding gap is formed between the cooling module and an inner surface of the lampshade. The light-emitting element is coupled with the cooling module. The circuit board is electrically connected to the base and the light-emitting element and has a first end edge and a second end edge opposing to the first end edge. The circuit board further includes two layout surfaces opposing to each other between the first and second end edges. A plurality of electronic components is mounted on one or both of the two layout surfaces. The inner surface of the lampshade forms an air-guiding face between the base and the opening. The two layout surfaces of the circuit board, the air-guiding face of the lampshade, and the cooling fan jointly constructs an air channel. The two layout surfaces of the circuit board face the air-guiding face. At least one of the electronic components is located in the air channel.

In another preferred form shown, a plurality of first fixing portions is arranged on a periphery of the cooling fan. The circuit board includes a plurality of second fixing portions engaged with the plurality of first fixing portions of the cooling fan.

In the preferred form shown, the plurality of first fixing portions is in the form of two notches opposing to each other, the plurality of second fixing portions is in the form of two projections spaced from each other on the second end edge. The two projections of the circuit board are respectively engaged with the two notches of the cooling fan.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
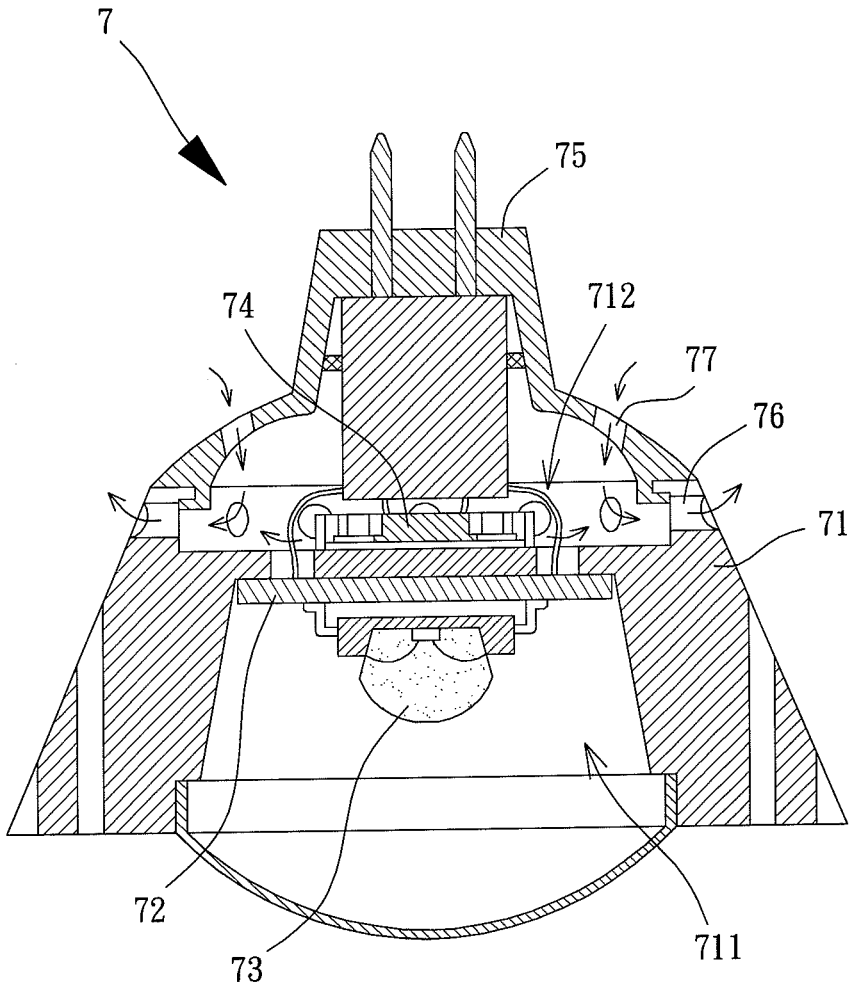
FIG. 1 PRIOR ART
FIG. 1 is a cross-sectional view of a conventional lamp.
Figure 2:
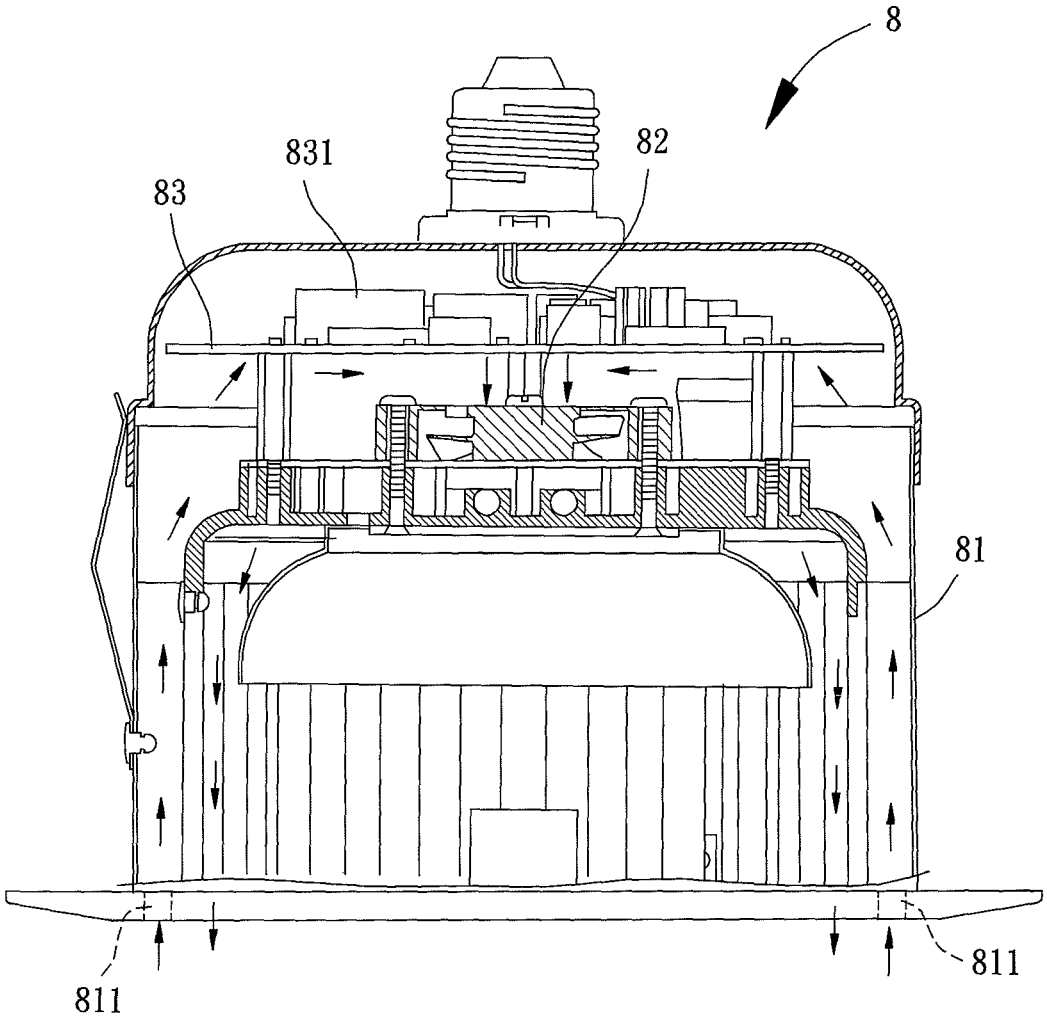
FIG. 2 PRIOR ART
FIG. 2 is a cross-sectional view of another conventional lamp.
Figure 3:
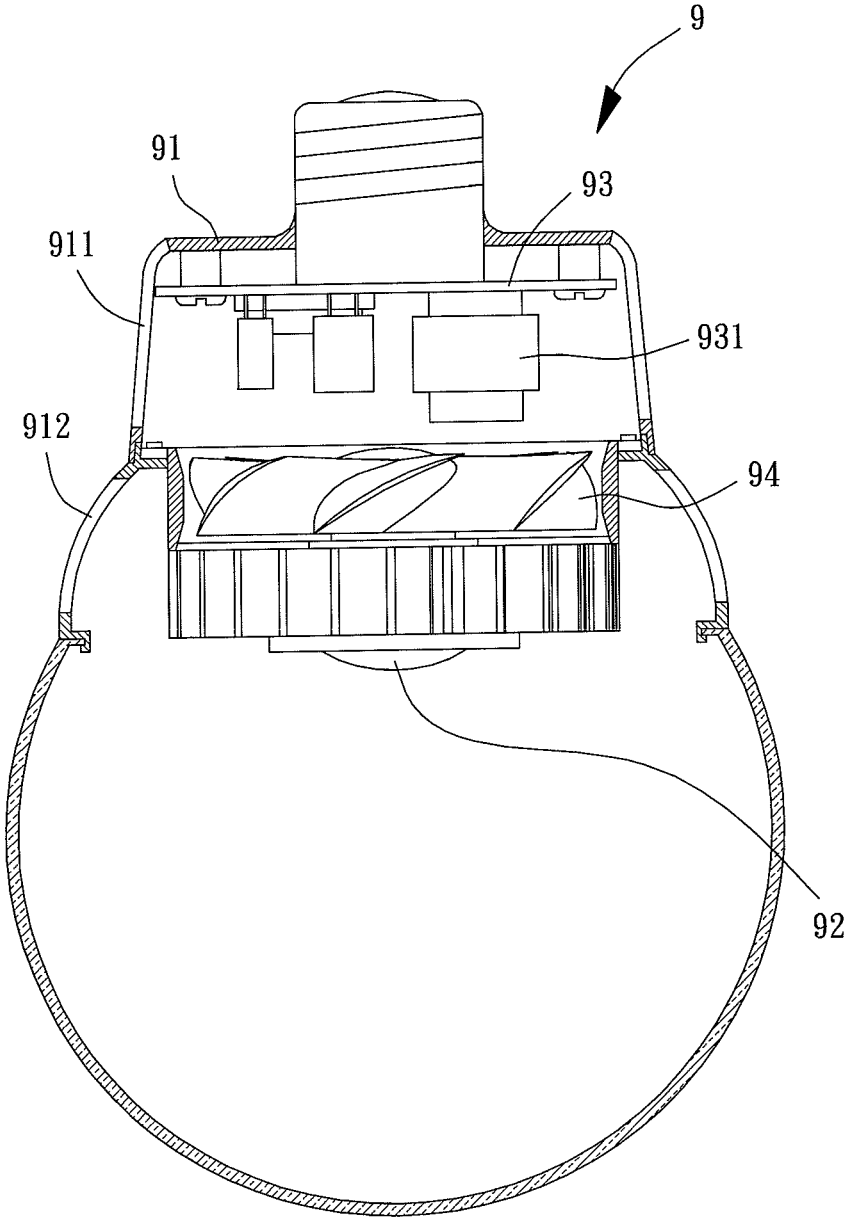
FIG. 3 PRIOR ART
FIG. 3 is a cross-sectional view of yet another conventional lamp.

In the various figures of the drawings, the same numerals designate the same or similar parts. Furthermore, when the term "first", "second", "third", "fourth", "inner", "outer" "top", "bottom" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 4:
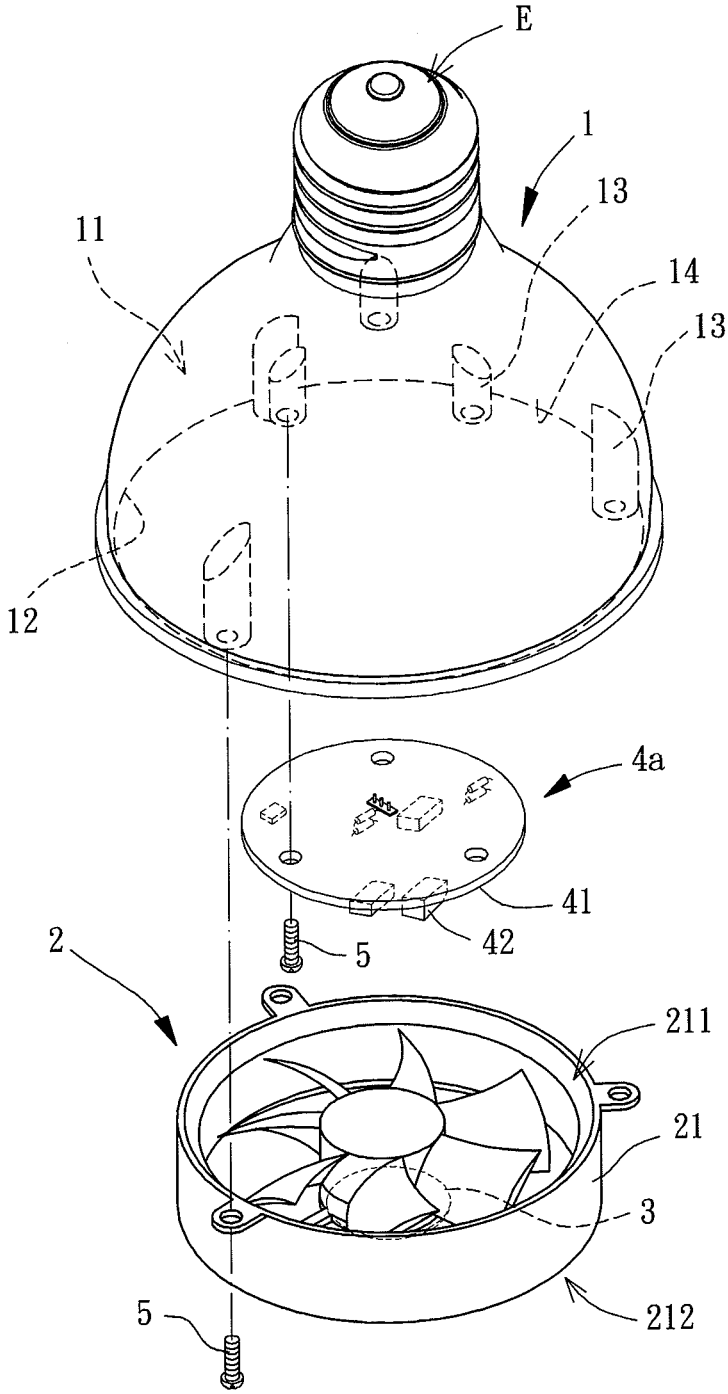
FIG. 4 is an exploded view of a lamp according to a first embodiment of the invention.
Figure 5:
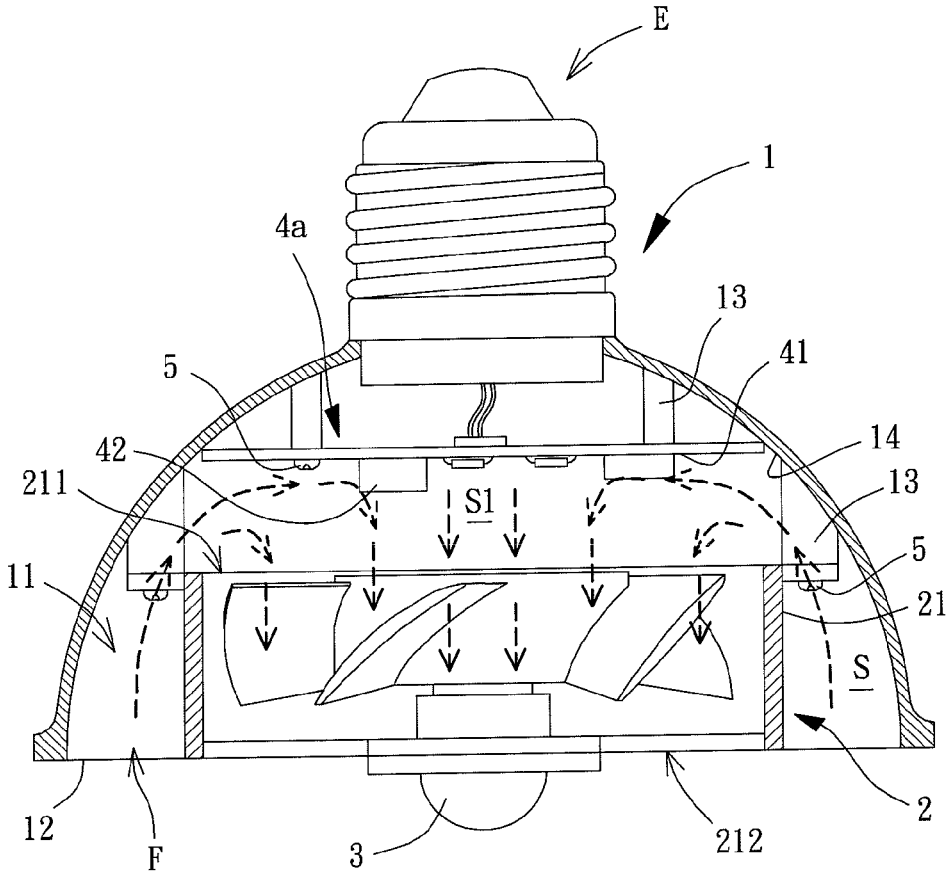
FIG. 5 is a cross-sectional view of the lamp of the first embodiment of the invention.

FIGS. 4 and 5 show a lamp including a lampshade 1, a cooling module 2, a light-emitting element 3 and a circuit board 4*a* according to a first embodiment of the invention. The lampshade 1 is provided to couple with the cooling module 2 and the circuit board 4*a*. The cooling module 2 and the circuit board 4*a* are installed in the lampshade 1. The light-emitting element 3 is coupled with the cooling module 2. The circuit board 4*a* is electrically connected to the light-emitting element 3.

The lampshade 1 forms a chamber 11 for receiving the cooling module 2 and the circuit board 4*a*. The lampshade 1 forms an opening 12 at one end thereof to allow the external air to flow into the chamber 11 through the opening 12. In the embodiment, the lampshade 1 preferably includes a plurality of fixing posts 13 adapted to fix the cooling module 2 and the circuit board 4*a* together. The lamp further includes a base E protruding from the other end of the lampshade 1. The base E may be of any structures that can be electrically connected to an external power, acting as a power source.

Referring to FIG. 5, the lampshade 1 does not need to form any aperture between the base E and the opening 12, rendering the lampshade 1 completely closed (solid or without holes) between the base E and the opening 12. The lampshade 1 has an inner surface forming an air-guiding face 14 between the base E and the opening 12. The air-guiding face 14 is preferably in an annular form whose diameter is gradually reduced from the opening 12 to the base E. In this arrangement, when the cooling module 2 guides air into the chamber 11 via the opening 12, the annular air-guiding face 14 will better concentrate the air on the circuit board 4*a* for cooling purposes.

The cooling module 2 is preferably disposed at the opening 12 of the lampshade 1. As shown in FIG. 5, at least one air-guiding gap F is formed between the cooling module 2 and the inner surface of the lampshade 1.

In the embodiment, the cooling module 2 includes a cooling fan 21 that will be screwed onto the fixing posts 13 in the chamber 11 using a plurality of fixing members 5 such as screws. The cooling fan 21 has an air inlet 211 and an air outlet 212 for guiding air into and out of the cooling fan 21. The detailed structures and operations of the cooling fan 21 are not described herein again, as it can be readily appreciated by one skilled in the art.

Referring to FIG. 5 again, the air inlet 211 of the cooling fan 21 may face the inner surface of the lampshade 1, whereas the air outlet 212 of the cooling fan 21 may face away from the inner surface of the lampshade 1. Specifically, the air inlet 211 of the cooling fan 21 may face the base E and the air outlet 212 of the cooling fan 21 may face away from the base E. At this point, the air-guiding gap F acts as an airflow entrance. The cooling fan 21 will guide air into the chamber 11 through the airflow entrance. The air will be discharged from the chamber 11 via the air inlet 211 and the air outlet 212 of the cooling fan 21. Alternatively, the air outlet 212 of the cooling fan 21 may face the inner surface of the lampshade 1, whereas the air inlet 211 of the cooling fan 21 may face away from the inner surface of the lampshade 1. At this point, the air-guiding gap F acts as an airflow exit when the cooling fan 21 guides air into the chamber 11 via the air inlet 211 and the air outlet 212. Air will be discharged from the chamber 11 via the air-guiding gap F.

The light-emitting element 3 is coupled with the cooling module 2 so that the cooling module 2 will expel the heat of the light-emitting element 3, attaining an improved cooling effect.

The circuit board 4*a* will also be screwed onto the fixing posts 13 in the chamber 11 via the plurality of fixing members 5. The circuit board 4*a* will be electrically connected to the base E and the light-emitting element 3 to provide power to the light-emitting element 3. The circuit board 4*a* has a layout surface 41. A plurality of electronic components 42 is mounted on the layout surface 41 to control the operations of the light-emitting element 3. The layout surface 41 and the electronic components 42 face the opening 12 of the lampshade 1. Referring to FIG. 5 again, an air channel S is formed by the layout surface 41, the air-guiding face 14 and the cooling fan 21. At least one of the electronic components 42 may be located in the air channel S. When the cooling fan 21 guides air into and out of the chamber 11 via the air-guiding gap F, the cooling fan 21 will drive the air through the electronic components 42 of the circuit board 4*a* for cooling purposes. In addition, the air channel S includes an air-diverting channel S1 being the portion of the air channel S corresponding with the cooling fan 21 in an axial direction. Preferably, the air channel S includes an air-diverting channel S1 being the portion of the air channel S located above the cooling fan 21. The electronic components 42 are preferably located in the air-diverting channel S1 to attain better cooling effect.

When the lamp of the invention is in use, the lamp may be installed in the wall or ceiling for illumination purposes. As an example, the lampshade 1 of the lamp may be inserted into and settled above the decorated ceiling when the opening 12 and the light-emitting element 3 are exposed to the room. Since the air-guiding gap F is formed between the cooling module 2 and the inner surface of the lampshade 1, the air-guiding gap F will be able to be exposed to the room. Thus, when the cooling fan 21 of the cooling module 2 operates, air is guided into and out of the chamber 11 via the air-guiding gap F to expel the heat generated by the light-emitting element 3.

Based on the structural characteristics described above, it is recognized that the lampshade 1 does not have to form any apertures between the opening 12 and the base E. In other words, the lampshade 1 is completely closed (solid or without holes) between the base E and the opening 12, forming the air-guiding gap F simply between the cooling module 2 and the lampshade 1 at the opening 12. Because the lampshade 1 does not have to form any air inlets or air outlets between the opening 12 and the base E, the structure of the lamp is simplified. Therefore, the manufacturing process will be more convenient and the cost will be reduced. The appearance integrity of the lamp is also maintained for aesthetics.

Moreover, since the electronic components 42 of the circuit board 4*a* faces the opening 12 of the lampshade 1, the electronic components 42 are located between the circuit board 4*a* and the cooling module 2. In this arrangement, since the space between the electronic components 42 and the cooling fan 21 of the cooling module 2 is not blocked, the air driven by the cooling fan 21 will be able to pass through the electronic components 42 when the cooling fan 21 guides air into and out of the air channel S via the air-guiding gap F. As such, the electronic components 42 will be efficiently cooled down. Furthermore, the air-guiding gap F may be exposed to the room when the lamp is installed in the decorated ceiling, allowing the air to be smoothly guided into and out of the lamp via the air-guiding gap F. Thus, the cooling efficiency is improved and the service life of the lamp is prolonged.

Figure 6:
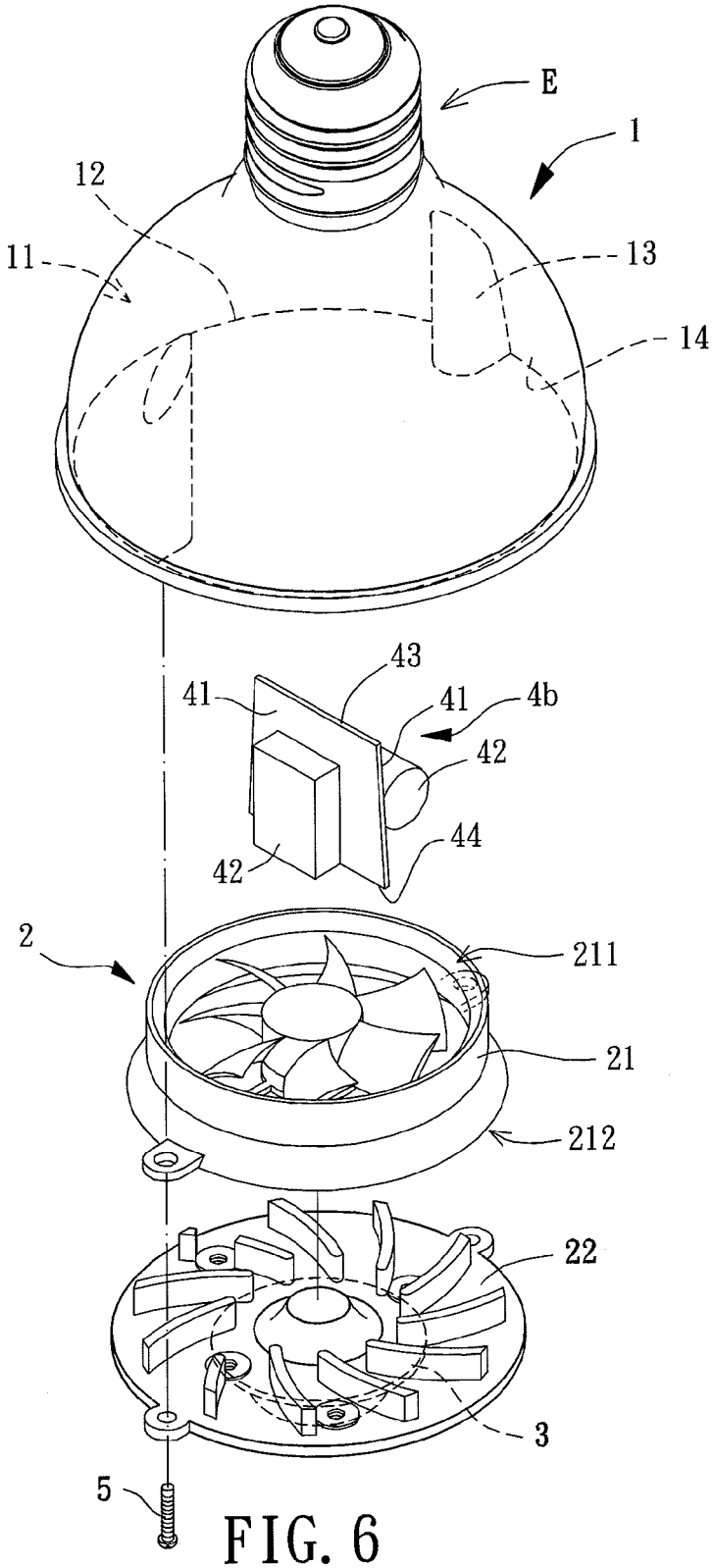
FIG. 6 is an exploded view of a lamp according to a second embodiment of the invention.
Figure 7:
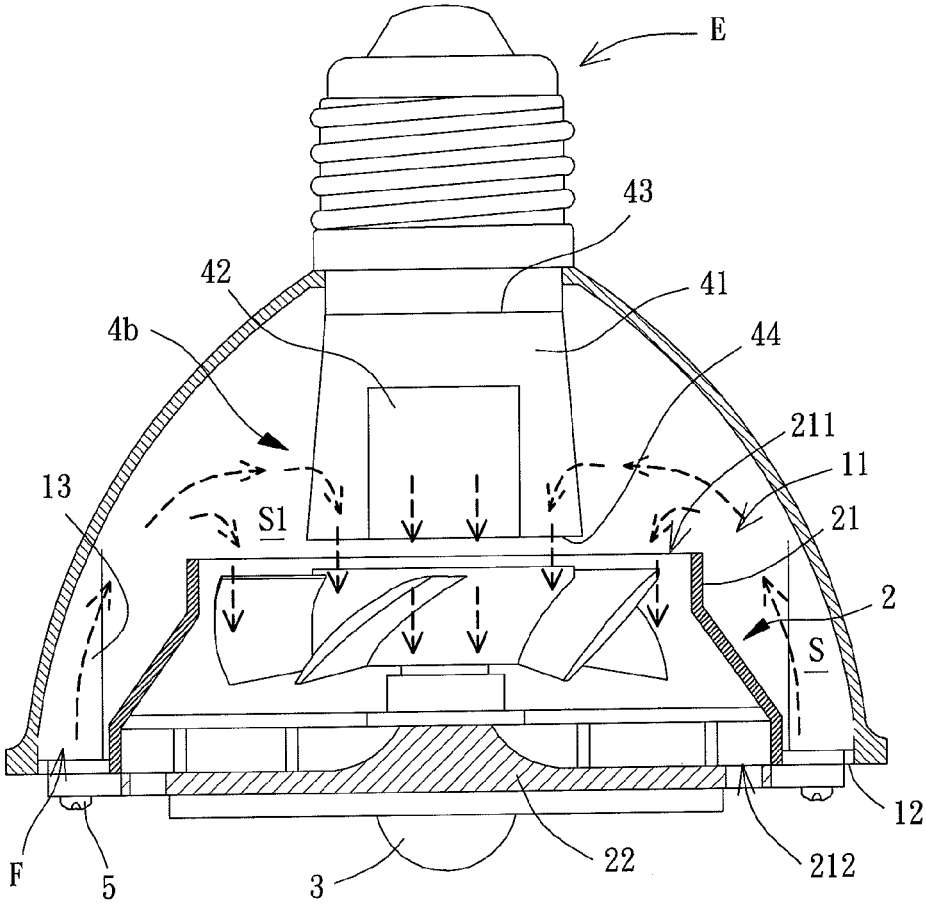
FIG. 7 is a cross-sectional view of the lamp of the second embodiment of the invention.

Referring to FIGS. 6 and 7, a lamp including a lampshade 1, a cooling module 2, a light-emitting element 3 and a circuit board 4*b* is disclosed according to a second embodiment of the invention. The lampshade 1, the cooling module 2 and the light-emitting element 3 disclosed in the second embodiment are similar to those disclosed in the first embodiment, so they are not described herein again for brevity.

The differences between the lamps in the first and second embodiments are described herein in this paragraph. The circuit board 4*b* has a first end edge 43 and a second end edge 44 opposing the first end edge 43. The circuit board 4*b* includes two layout surfaces 41 between the first end edge 43 and the second end edge 44, with both the layout surfaces 41 facing the air-guiding face 14. The electronic components 42 are mounted on one or both of the layout surfaces 41. The first end edge 43 of the circuit board 4*b* faces the base E, and the second end edge 44 faces the opening 12 of the lampshade 1. In this arrangement, both the layout surfaces 41 and the electronic components 42 face the air-guiding face 14 of the lampshade 1.

Referring to FIG. 7, an air channel S is formed between the layout surfaces 41 of the circuit board 4*b*, the air-guiding face 14 of the lampshade 1, and the cooling fan 21. The air channel S preferably includes an air-diverting channel S1 being the part of the air channel S that corresponds to the cooling fan 21. Preferably, the air channel S preferably includes an air-diverting channel S1 being the part of the air channel S located above the cooling fan 21. Thus, the electronic components 42 are also located in the air channel S. Preferably, the electronic components 42 are located in the air-diverting channel S1 to obtain better cooling effect. In the embodiment, the cooling module 2 further includes a cooling seat 22 that is made of heat-conducting material and has a plurality of fins. The light-emitting element 3 will couple with one face of the cooling seat 22 while the cooling fan 21 is coupled with the other face of the cooling seat 22. At this point, the cooling seat 22 is sandwiched between the cooling fan 21 and the light-emitting element 3. Through the heat conductibility of the cooling seat 22 and the arrangement of the cooling fan 21, the cooling seat 22 will provide improved cooling effect to the light-emitting element 3.

Based on the structure described above, the lampshade 1 does not need to form any apertures between the opening 12 and the base E. Namely, the lampshade 1 is completely closed (solid or without holes) between the base E and the opening 12. Therefore, convenient manufacturing and cost reduction are achieved while appearance integrity is maintained for aesthetics. Since the electronic components 42 are located above the cooling module 2, the cooling fan 21 will be able to drive the air through the electronic components 42 of the circuit board 4*b* for cooling purposes when the cooling fan 21 guides air into and out of the chamber 11 via the air-guiding gap F. Thus, the heat of the electronic components 42 will be efficiently expelled, prolonging the service life of the lamp.

In contrast to the circuit board 4*a* in the first embodiment, both layout surfaces 41 of the circuit board 4*b* face the air-guiding face 14 of the lampshade 1. Since the circuit board 4*b* is set upright, the cooling fan 21 will be able to drive the air through the electronic components 42 no matter the electronic components 42 are mounted on which of the layout surfaces 41. In particular, the electronic components 42 will have a better cooling effect when the inner surface of the lampshade 1 is annular. In the other case where the electronic components 42 are mounted on both layout surfaces 41 of the circuit board 4*b*, the air will be able to flow through both layout surfaces 41 of the circuit board 4*b* to efficiently expel the heat of the electronic components 42, thereby providing improved cooling effect.

Figure 8:
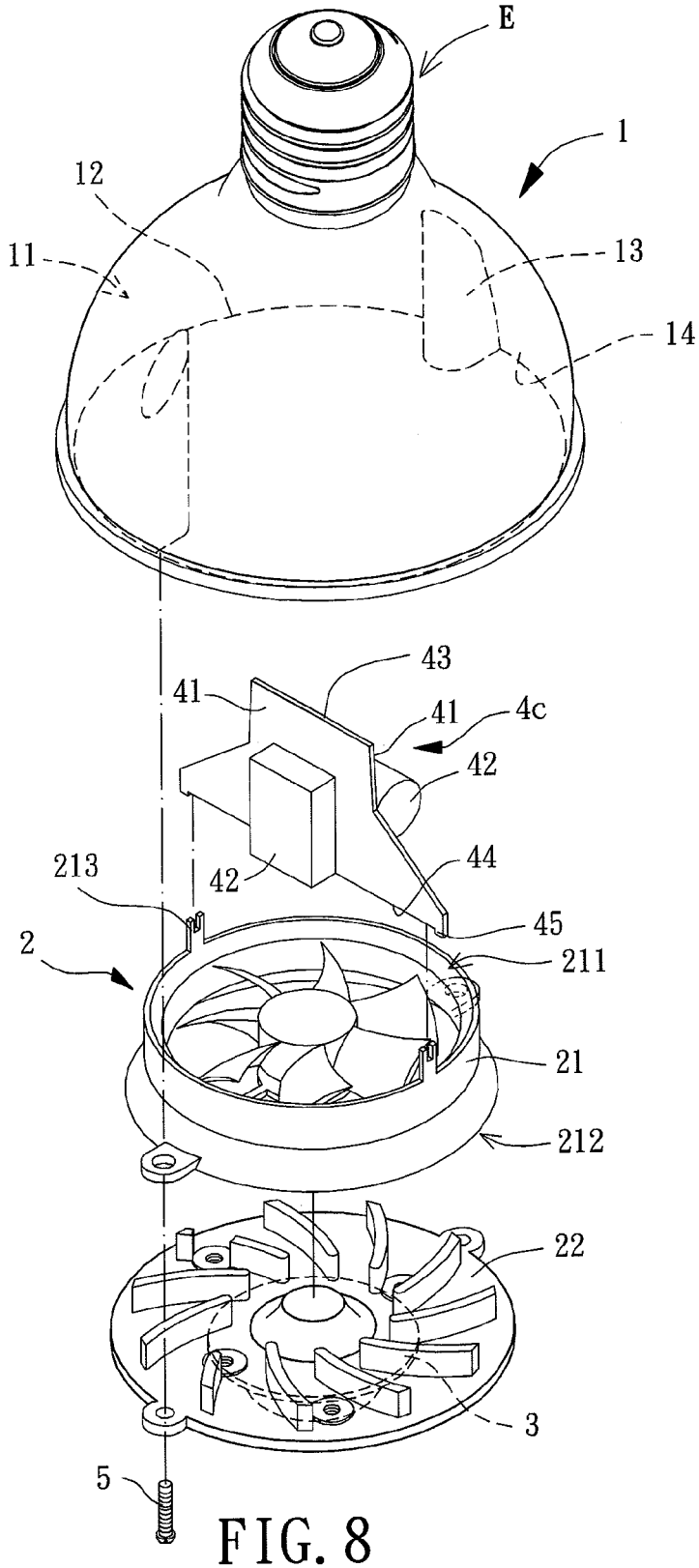
FIG. 8 is an exploded view of a lamp according to a third embodiment of the invention.
Figure 9:
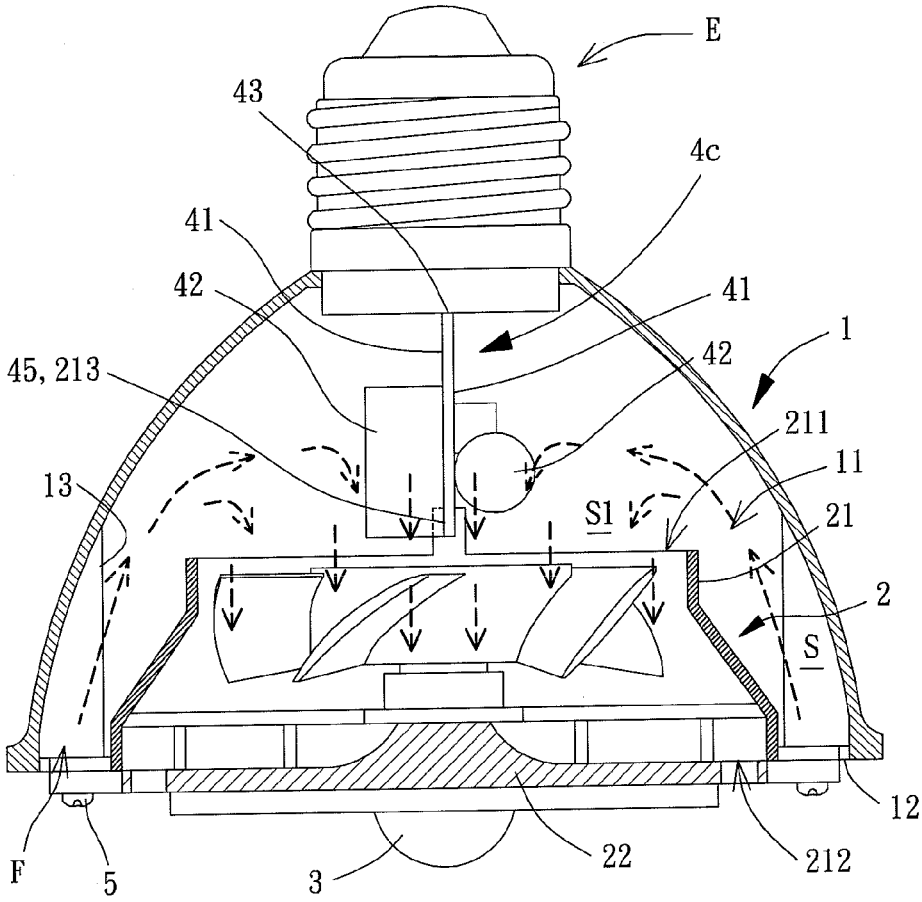
FIG. 9 is a cross-sectional view of the lamp of the third embodiment of the invention.

Referring to FIGS. 8 and 9, a lamp including a lampshade 1, a cooling module 2, a light-emitting element 3 and a circuit board 4*c* is disclosed according to a third embodiment of the invention. The lampshade 1, the cooling module 2 and the light-emitting element 3 disclosed in the third embodiment are similar to those disclosed in the first embodiment, so they are not described herein again for brevity.

The lamp in the third embodiment differs from that in the first embodiment in that the circuit board 4*c* has a first end edge 43 and a second end edge 44 opposing the first end edge 43. The circuit board 4*c* includes two layout surfaces 41 between the first end edge 43 and the second end edge 44, with both the layout surfaces 41 facing the air-guiding face 14. The electronic components 42 are mounted on at least one of the two layout surfaces 41. The first end edge 43 of the circuit board 4*c* faces the base E, the second end edge 44 faces the opening 12 of the lampshade 1. In this arrangement, both the layout surfaces 41 and the electronic components 42 face the air-guiding face 14 of the lampshade 1. Thus, the electronic components 42 are located in the air channel S. Preferably, the electronic components 42 are located in the air-diverting channel S1. In the embodiment, the cooling module 2 also includes a cooling seat 22. The light-emitting element 3 will couple with one face of the cooling seat 22 while the cooling fan 21 is coupled with the other face of the cooling seat 22. At this point, the cooling seat 22 is sandwiched between the cooling fan 21 and the light-emitting element 3. The cooling seat 22 will provide improved heat dissipation to the light-emitting element 3 through the cooling seat 22.

Moreover, a plurality of first fixing portions 213 is formed on a periphery of the cooling fan 21. In this embodiment, the plurality of first fixing portions 213 is in the form of two notches opposing each other. Based on this, the circuit board 4*c* can be fastened on the cooling fan 21. The circuit board 4*c* may also be disassembled from the cooling fan 21 if necessary. The circuit board 4*c* includes a plurality of second fixing portions 45 to be fastened on the plurality of first fixing portions 213 of the cooling fan 21. In this embodiment, the plurality of second fixing portions 45 may be in the form of two projections spaced from each other on the second end edge 44. When the circuit board 4*c* is fastened on the cooling fan 21, the two projections of the circuit board 4*c* will be respectively engaged with the two notches of the cooling fan 21. As such, secure engagement between the circuit board 4*c* and the cooling fan 21 is provided while undesired shift of the circuit board 4*c* is prevented. The first fixing portions 213 and the second fixing portions 45 described above may be of any structures capable of mutual assembly, such as a fastening mechanism, a screwing mechanism, an adhering mechanism, etc.

Based on the structural characteristics described above, it is recognized that the lampshade 1 in this embodiment does not have to form any apertures between the opening 12 and the base E either. Advantageously, convenient manufacturing and cost reduction are achieved while the appearance integrity is maintained for aesthetic. Furthermore, since the electronic components 42 of the circuit board 4*c* are located in the air channel S, the cooling fan 21 may be able to drive the air through the electronic components 42 of the circuit board 4*c* for cooling purposes when the cooling fan 21 guides air into and out of the chamber 11 via the air-guiding gap F. Thus, the heat of the electronic components 42 will be efficiently expelled, prolonging the service life of the lamp.

In contrast to the circuit boards 4*a* and 4*b* disclosed in the first and second embodiments, the lamp in the embodiment is characterized in the ability to assemble the circuit board 4*c* and the cooling fan 21 to each other using the first fixing portions 213 of the cooling fan 21 and the second fixing portions 45 of the circuit board 4*c*. Therefore, the circuit board 4*c* and the cooling fan 21 may be assembled together as a single assembly for installation in the lampshade 1, providing convenient assembly of electrical connection.

Based on the disclosed structures in the first, second and third embodiments, the air-guiding gap F between the lampshade 1 and the cooling module 2 may have four types of air-flowing patterns:

A. axial in and axial out;

B. radial in and radial out;

C. axial in and radial out; and

D. radial in and axial out.

Figure 10:
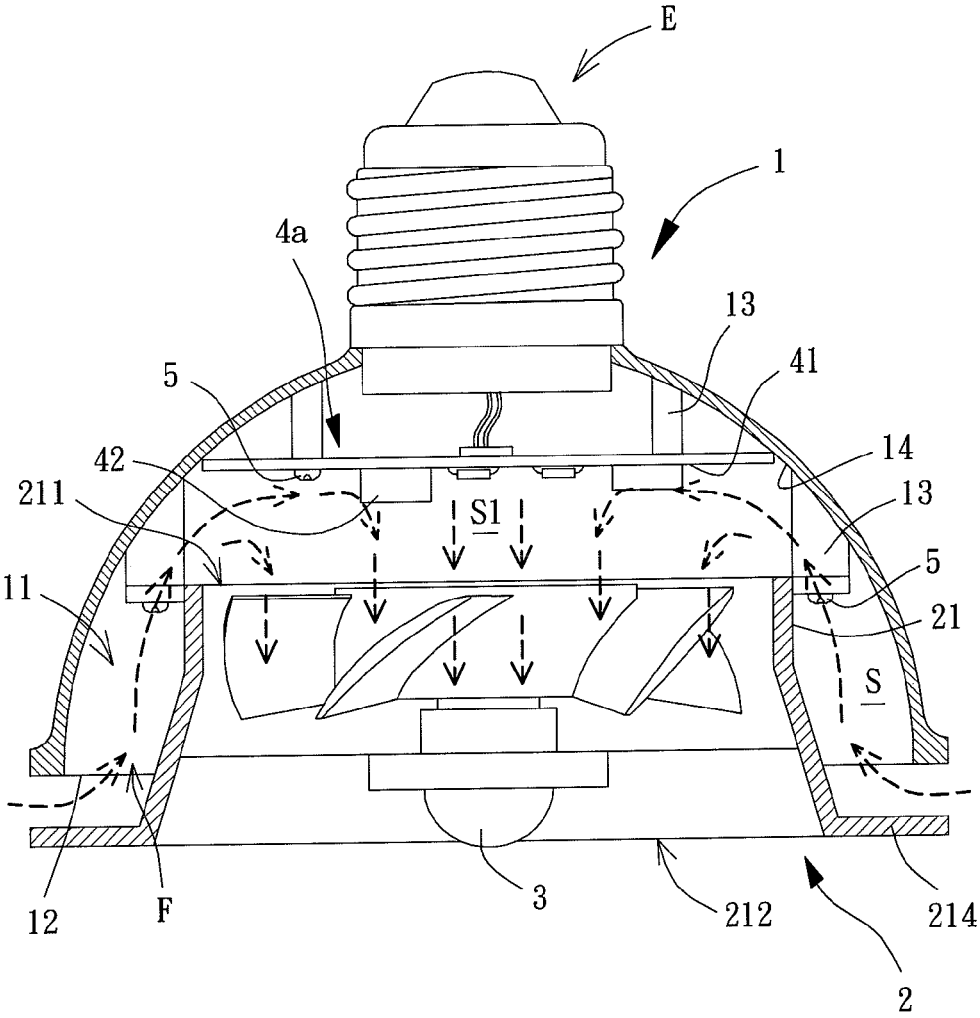
FIG. 10 is a cross-sectional view of a modified lamp of the first embodiment which includes an air inlet and an air outlet, in which air enters the air inlet in a radial direction and exits from the air outlet in an axial direction.

For example, referring to FIGS. 5, 7 and 9, the air-guiding gap F has the first air-flowing pattern "axial in and axial out". In other words, when the cooling fan 21 rotates in one direction, the air is guided into the chamber 11 via the air-guiding gap F in an axial direction of the lamp. Similarly, when the cooling fan 21 rotates in the other direction, the air is guided out of the chamber 11 via the air-guiding gap F in the axial direction of the lamp. Alternatively, as shown in FIG. 10, the cooling module 2 forms a radial extension portion 214 at the bottom edge thereof. The radial extension portion 214 divides the air-guiding gap F into a radial airflow entrance and an axial airflow exit, as specified in the fourth air-flowing pattern "radial in and axial out" above. In comparison to the first air-flowing pattern "axial in and axial out", the air-flowing pattern "axial in and radial out (or radial in and axial out)" as shown in FIG. 10 will better prevent turbulences from forming during the operations of the cooling fan 21.

The lamps in the first, second and third embodiments will provide many advantages, as described below.

First, since the lampshade 1 is completely closed between the opening 12 and the base E, the lampshade 1 does not have to form any apertures. Thus, the lamp provides both simplified structure and better appearance integrity at the same time.

Second, based on the primary feature above, the electronic components 42 of the circuit boards 4*a*, 4*b* and 4*c* may be located in the air channel S while facing the opening 12 of the lampshade 1. Thus, air driven by the cooling fan 21 of the cooling module 2 will be able to reach the electronic components 42, ensuring the normal operation of the lamp and prolonging the service life of the lamp.

In this disclosure, the air-guiding gap F may be exposed to the room when the lamp is installed in the decorated ceiling, allowing the air to be smoothly guided into and out of the lamp via the air-guiding gap F. Thus, the cooling efficiency is improved and the service life of the lamp is prolonged.

Although the invention has been described in detail with reference to its presently preferable embodiment, it will be understood by one of ordinary skill in the art that various modifications can be made without departing from the spirit and the scope of the invention, as set forth in the appended claims.

What is claimed is:

1. A lamp comprising:

a lampshade including an opening and a base at two ends thereof, and forming a chamber in communication with the opening, wherein the lampshade is completely closed between the opening and the base;

a cooling module including a cooling fan fixed in the chamber of the lampshade, wherein at least one air-guiding gap is formed between the cooling module and an inner surface of the lampshade;

a light-emitting element coupled with the cooling module; and a circuit board electrically connected to the base and the light-emitting element and having a layout surface mounted with a plurality of electronic components, wherein the inner surface of the lampshade forms an air-guiding face between the base and the opening, wherein the layout surface of the circuit board, the air-guiding face of the lampshade, and the cooling fan jointly form an air channel, wherein the layout surface and the electronic components of the circuit board face the opening of the lampshade, and wherein at least one of the electronic components is located in the air channel.

2. The lamp as claimed in claim 1, wherein the air-guiding face of the lampshade is in an annular form and has a diameter gradually reduced from the opening to the base.

3. The lamp as claimed in claim 1, wherein the cooling fan includes an air inlet facing the base and an air outlet facing away from the base, and wherein the at least one air-guiding gap acts as an airflow entrance.

4. The lamp as claimed in claim 1, wherein the cooling fan includes an air outlet facing the base and an air inlet facing away from the base, and wherein the at least one air-guiding gap acts as an airflow exit.

5. The lamp as claimed in claim 1, wherein the air channel includes an air-diverting channel being the part of the air channel that corresponds to the cooling fan in an axial direction, and wherein the at least one of the electronic components is located in the air-diverting channel.

6. The lamp as claimed in claim 1, wherein the lampshade includes a plurality of fixing posts in the chamber, and wherein the cooling fan of the cooling module and the circuit board are fixed to the fixing posts via a plurality of fixing members.

7. The lamp as claimed in claim 1, wherein the cooling module further includes a cooling seat, wherein the light-emitting element is coupled with one face of the cooling seat, and wherein the cooling fan is coupled with the other face of the cooling seat, thereby positioning the cooling seat between the light-emitting element and the cooling fan.

8. The lamp as claimed in claim 1, wherein the cooling module has a bottom edge forming a radial extension portion, wherein the radial extension portion divides the at least one air-guiding gap into a radial airflow entrance and an axial airflow exit, or divides the at least one air-guiding gap into a radial airflow exit and an axial airflow entrance.

9. A lamp comprising:

a lampshade including an opening and a base at two ends thereof, and forming a chamber in communication with the opening, wherein the lampshade is completely closed between the opening and the base;

a cooling module including a cooling fan fixed in the chamber of the lampshade, wherein at least one air-guiding gap is formed between the cooling module and an inner surface of the lampshade;

a light-emitting element coupled with the cooling module; and a circuit board electrically connected to the base and the light-emitting element and having a first end edge and a second end edge opposing the first end edge, wherein the circuit board further includes two layout surfaces opposing to each other between the first and second end edges, and wherein a plurality of electronic components is mounted on one or both of the two layout surfaces, wherein the inner surface of the lampshade forms an air-guiding face between the base and the opening, wherein the two layout surfaces of the circuit board, the air-guiding face of the lampshade, and the cooling fan jointly construct an air channel, wherein the two layout surfaces of the circuit board face the air-guiding face, and wherein at least one of the electronic components is located in the air channel.

10. The lamp as claimed in claim 9, wherein a plurality of first fixing portions is arranged on a periphery of the cooling fan, wherein the circuit board further includes a plurality of second fixing portions engaged with the plurality of first fixing portions of the cooling fan.

11. The lamp as claimed in claim 10, wherein the plurality of first fixing portions is in the form of two notches opposing each other, wherein the plurality of second fixing portions is in the form of two projections spaced from each other on the second end edge, and wherein the two projections of the circuit board are respectively engaged with the two notches of the cooling fan.

12. The lamp as claimed in claim 9, wherein the air-guiding face of the lampshade is in an annular form and has a diameter gradually reduced from the opening to the base.

13. The lamp as claimed in claim 9, wherein the cooling fan includes an air inlet facing the base and an air outlet facing away from the base, and wherein the at least one air-guiding gap acts as an airflow entrance.

14. The lamp as claimed in claim 9, wherein the cooling fan includes an air outlet facing the base and an air inlet facing away from the base, and wherein the at least one air-guiding gap acts as an airflow exit.

15. The lamp as claimed in claim 9, wherein the lampshade includes a plurality of fixing posts in the chamber, and wherein the cooling fan of the cooling module and the circuit board are fixed to the fixing posts via a plurality of fixing members.

16. The lamp as claimed in claim 9, wherein the cooling module further includes a cooling seat, wherein the light-emitting element is coupled with one face of the cooling seat, and wherein the cooling fan is coupled with the other face of the cooling seat, thereby positioning the cooling seat between the light-emitting element and the cooling fan.

17. The lamp as claimed in claim 9, wherein the air channel includes an air-diverting channel being the part of the air channel that corresponds to the cooling fan in an axial direction, and wherein the at least one of the electronic components is located in the air-diverting channel.

18. The lamp as claimed in claim 9, wherein the cooling module has a bottom edge forming a radial extension portion, and wherein the radial extension portion divides the at least one air-guiding gap into a radial airflow entrance and an axial airflow exit, or divides the at least one air-guiding gap into a radial airflow exit and an axial airflow entrance.

* * * * *